US005368394A

United States Patent [19]

Scott et al.

[11] Patent Number: 5,368,394

[45] Date of Patent: Nov. 29, 1994

[54] STABILIZER WEDGE ZIPPER

[75] Inventors: Richmond M. Scott, Pleasantville; Zdenek Machacek, Nanuet, both of N.Y.

[73] Assignee: Minigrip, Inc., Orangeburg, N.Y.

[21] Appl. No.: 174,273

[22] Filed: Dec. 28, 1993

[51] Int. Cl.[5] ..... B65D 33/24

[52] U.S. Cl. ..... 383/63; 383/65; 24/587

[58] Field of Search ..... 383/63, 65; 24/576, 24/587, 399

[56] References Cited

U.S. PATENT DOCUMENTS 4,736,496 4/1988 Fisher et al. ..... 383/63 X
4,829,641 5/1989 Williams ..... 383/63 X
4,964,739 10/1990 Branson et al. ..... 383/63 X

*Primary Examiner*—Allan N. Shoap
*Assistant Examiner*—Jes F. Pascua
*Attorney, Agent, or Firm*—Kane, Dalsimer, Sullivan, Kurucz, Levy, Eisele and Richard

[57] ABSTRACT

A reclosable bag is formed of walls defining a closure with a mouth. The closure includes an asymmetric arrowhead male profile extending along an internal surface of one of the walls and a female profile having stubs adapted to interengage with said male profile and extending along an internal surface of the other wall. Both profiles also include stabilizer wedges on both sides thereof and parallel thereto across the width of the bag. The stabilizer wedges give the zipper formed by the male and female profiles a wide-track feel, and determine the force required to open the bag both from inside and from outside.

8 Claims, 3 Drawing Sheets

STABILIZER WEDGE ZIPPER

BACKGROUND OF THE INVENTION

1. Field of the Invention

This invention pertains to the art of reclosable plastic bags having extruded zippers, and more particularly to a reclosable bag having fastener profiles having wedge-shaped stops, which facilitate the joining attachment of the fastener profiles and which determine the amount of pull force required to open the bags. The fastener profiles are further of a design which makes inadvertent opening of the bags less likely.

2. Description of the Prior Art

Reclosable bags used, for example, for storing household foodstuffs are typically made of polyethylene. As shown in U.S. Pat. No. 3,416,199 to Imamura commonly assigned with the present invention, a reclosable bag may be formed of two opposed walls equipped at the mouth with fastener profiles. These profiles include a male profile attached to one wall and a female profile on the other wall. The profiles are shaped so that, when they are aligned and pressed together into an engaging relationship, they form a continuous closure for the bag. The bag may be opened by pulling the walls apart thereby separating the profiles. Various geometric shapes and arrangements for such profiles are shown in U.S. Pat. Nos. 28,969; 3,323,707; 4,212,337; 4,363,345; 4,561,108; and 4,812,056. In addition, U.S. Pat. Nos. 4,736,496 and 5,012,561 disclose reclosable bags with profiles and internal ribs adjacent to the profiles. U.S. Pat. No. 4,822,539 discloses a reclosable bag with interlocking profiles, internal guiding ribs disposed adjacent to the profiles, and stabilizing beams disposed on the outside surface of the bag wall. U.S. Pat. No. 3,338,285 discloses a reclosable bag having several parallel interlocking male and female profiles. In general, the profiles must be such as to provide relatively high resistance to opening from inside the bag while rendering the bag relatively easy to open from the outside.

SUMMARY OF THE INVENTION

In view of the above, an objective of the present invention is to provide a reclosable bag with improved closure means resistant to inadvertent opening.

Other objectives and advantages of the invention will become apparent from the following description. A reclosable bag constructed in accordance with this invention includes a front wall and a rear wall joined to form an enclosure with a mouth defined by wall edges at the top of the bag and male and female profile means having male and female members for selectively opening and closing said mouth. Stabilizer wedges are provided on each of the male and female profile means. Specifically, a stabilizer wedge is provided on each side of the male and female members on the male and female profile means. The wedges keep the zipper parallel during the application of the zipper to the film from which the bag is made and have a stabilizing effect during the attachment process. Further, the wedge action controls the force required to open the bag, and substantially increases the inside resistance to opening pressure from the product within the bag. Finally, the stabilizer provides the zipper as a whole with a wide-track feel.

DETAILED DESCRIPTION OF THE PREFERRED EMBODIMENT

Figure 2:
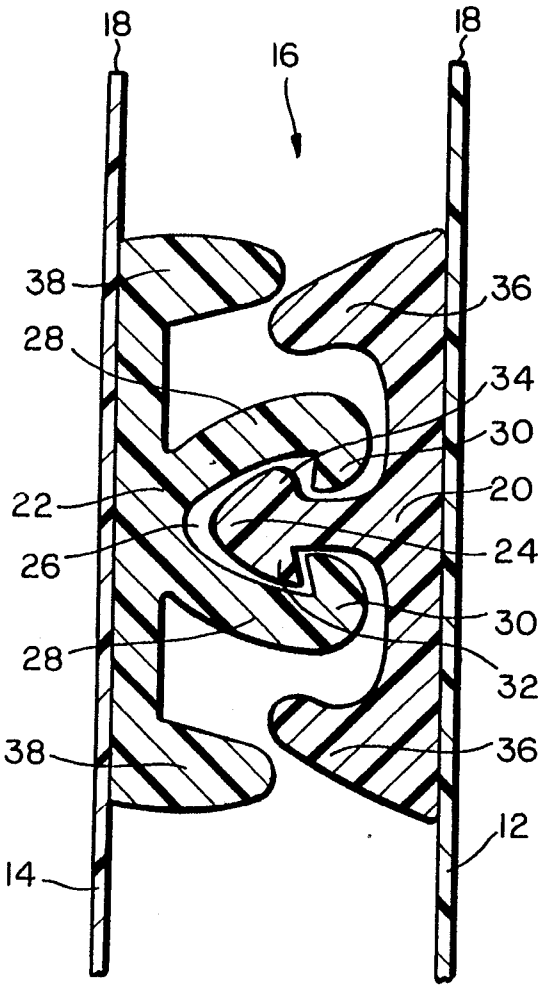
FIG. 2 shows an enlarged side sectional view of the bag opening.
Figure 1:
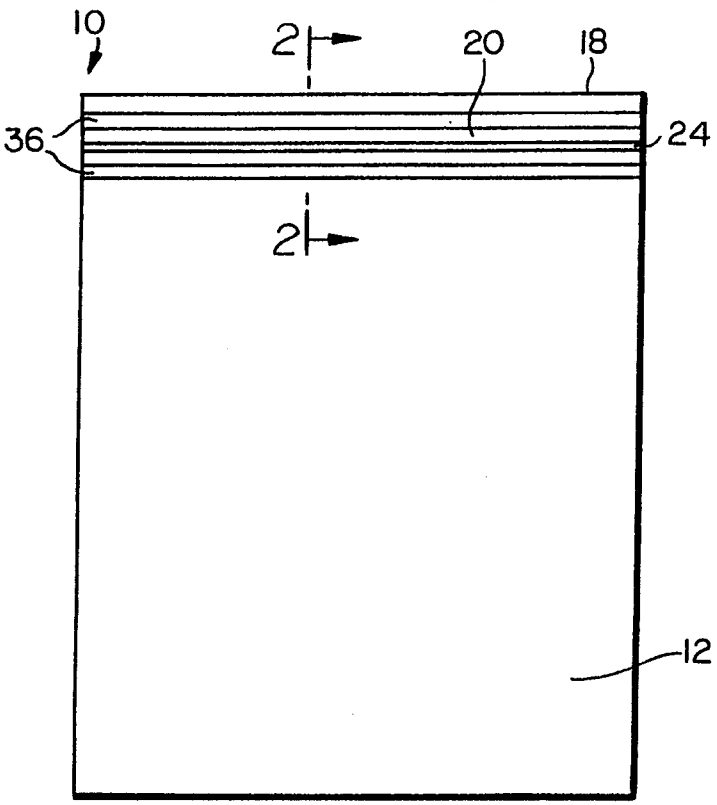
FIG. 1 shows a plan view of a reclosable bag constructed in accordance with the present invention.

Referring now to the drawings, and specifically to FIGS. 1 and 2, a reclosable bag 10 constructed in accordance with this invention includes front and rear walls 12,14 seamed along three edges thereby forming an enclosure with an opening or mouth 16 along the top or fourth edge 18. The bag 10 is preferably made of a thermoplastic material such as polyethylene by extrusion. Attached to internal faces, walls 12 and 14 are male and female profiles 20,22 respectively, which extend continuously from side to side of the bag. The profile serves to close the bag opening 16 when they are interlocked as shown in FIG. 2.

The male profile 20 includes an asymmetric arrowhead 24 which locks into a channel 26 formed by two inwardly curved members 28 having inwardly pointing stubs 30. The asymmetric arrowhead 24 is so called because its two barbs are not mirror images of one another. Barb 32 has an acute edge, while barb 34 has a rounded edge. Barb 34 is closer to the mouth 16 of the bag 10 than barb 32.

The male profile 20 has two stabilizer wedges 36, which are on each side of the asymmetric arrowhead 24 and are parallel thereto across the width of the bag 10. The stabilizer wedges 36 are inclined toward one another and toward asymmetric arrowhead 24.

In like manner, the female profile 22 has two stabilizer wedges 38, which are on each side of the inwardly curved members 28 and are parallel thereto across the width of the bag 10. The stabilizer wedges 38 are inclined away from one another, or, at least, have surfaces facing the inwardly curved members 28 which are inclined away from one another.

When the male and female profiles 20,22 are interengaged as shown in FIG. 2, stabilizer wedges 36 protrude to some preselected degree into the spaces between the stabilizer wedges 38 and the inwardly curved members 28 on the female profile 22.

Figure 3:
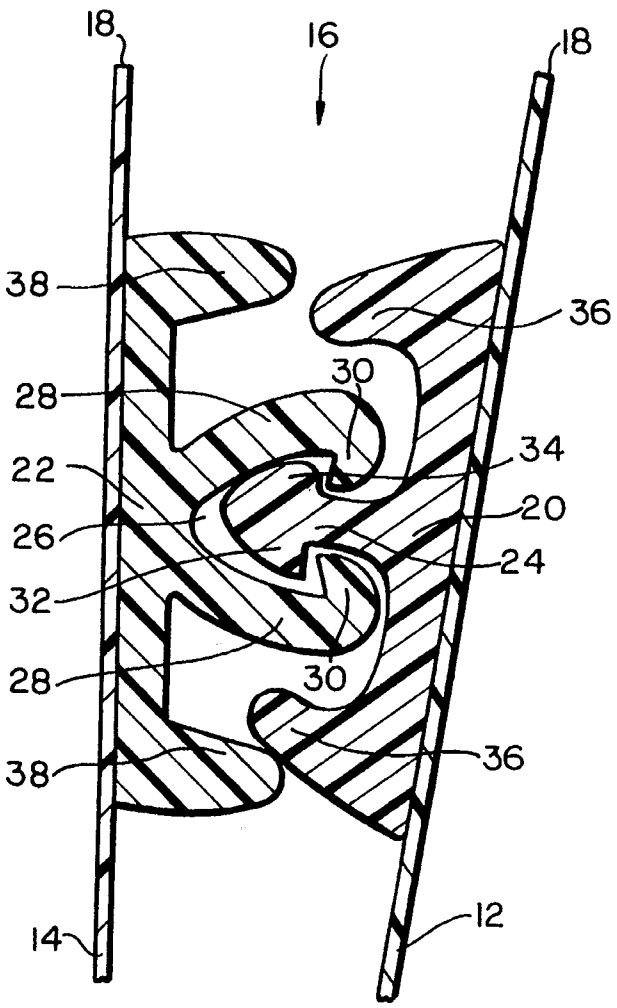
FIG. 3 shows an enlarged side sectional view, analogous to that presented in FIG. 2, of the bag being opened from the outside.

Bag 10 is normally opened by gripping edges 18 on the outside of the bag 10 and pulling them apart. In response to such action the lower stabilizer wedges 36,38, which are toward the inside of the bag 10, as shown in FIG. 3, abut against one another. This braces the male profile 20 against the female profile 22, and allows the rounded barb 34 of the asymmetric arrowhead 24 to glide past its adjacent stub 30 to open the bag 10. The force required to open the bag 10 may be preselected by appropriately choosing the angles at which the surfaces of stabilizer wedges 36,38 contact one another.

Figure 4:
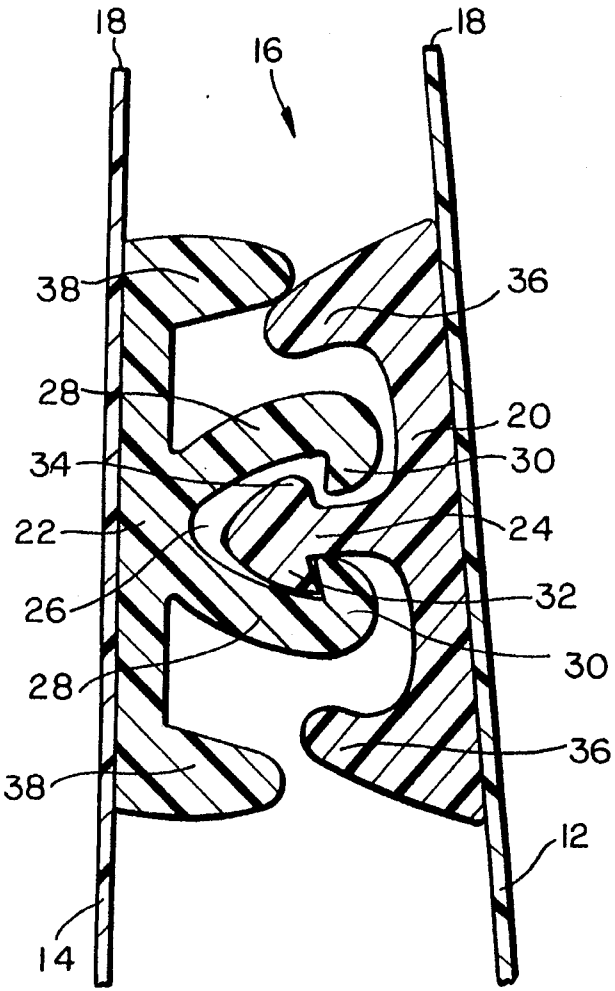
FIG. 4 shows another enlarged side sectional view, analogous to that presented in FIG. 2, of the bag being opened from the inside.

The situation that would arise from an opening force from within the bag 10 is shown in FIG. 4. In response to such action, the upper stabilizer wedges 36,38, which are toward the outside of the bag 10, as shown in FIG. 4, abut against one another. This again braces the male profile 20 against the female profile 22, and hooks the acute barb 32 of the asymmetric arrowhead 24 behind its adjacent stub 30 inhibiting the opening of the bag 10. The force required to open the bag 10 from within may be preselected by appropriately choosing the angles at which the surfaces of stabilizer wedges 36,38 contact one another.

Figure 5:
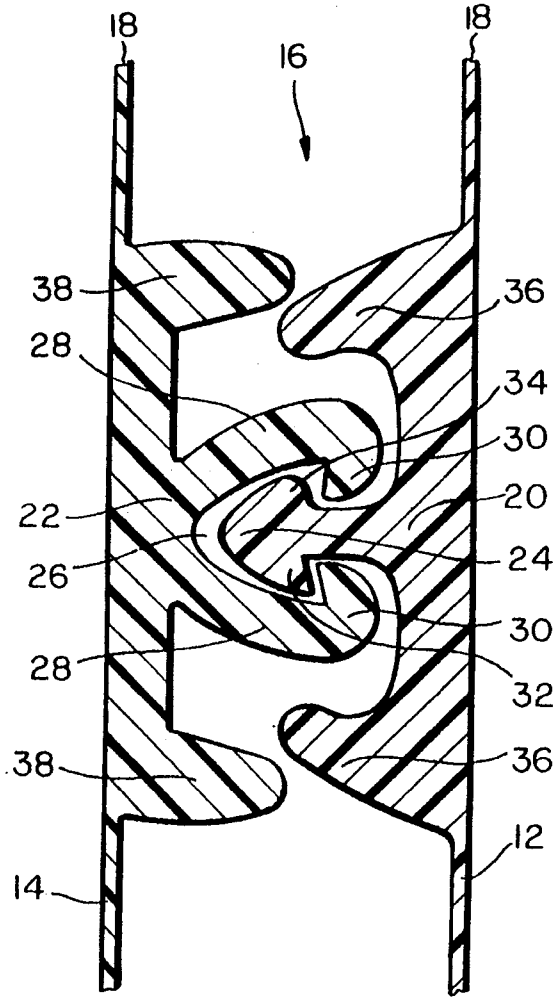
FIG. 5 is a figure similar to FIG. 2 depicting the male and female profiles being coextruded with the bag walls.

Bag 10 may be generated unitarily, for example, by extruding the walls 12,14, and the profiles 20,22 integrally as shown in FIG. 5. Alternatively, the closures may be extruded separately, and then may be bonded to sheets of bag forming material at some stage in the bag forming operation.

Obviously, numerous modifications may be made to this invention without departing from its scope as defined in the appended claims.

What is claimed is:

1. A reclosable bag comprising:

a first wall and a second wall joined to form an enclosure with a mouth defined by wall edges; and a closure for selectively opening and sealing said mouth, said closure comprising an asymmetric arrowhead male profile extending along an internal surface of said first wall and a female profile having stubs adapted to interengage with said male profile and extending along an internal surface of said second wall, wherein said male profile includes a first stabilizer wedge on one side thereof and parallel thereto, and a second stabilizer wedge on the other side thereof and parallel thereto across said bag, and wherein said female profile includes a first stabilizer wedge on one side thereof and parallel thereto, an a second stabilizer wedge on the other side thereof and parallel thereto across said bag, said first and second stabilizer wedges on said male and female profiles cooperating with one another to ensure that said male and female profiles remain parallel to one another when said reclosable bag is being manufactured and sealed, and increasing the rigidity of said closure to improve the alignment of said closure to said wall edges wherein said first and second stabilizer wedges of said male profile are inward of said first and second stabilizer wedges of said female profile with respect to said male and female profiles, when said male and female profiles are aligned to be interengaged.

2. The reclosable bag of claim 1 wherein said first and second stabilizer wedges of said male profile are inclined inwardly toward said male profile.

3. The reclosable bag of claim 1 wherein said first and second stabilizer wedges of said female profile are inclined outwardly from said female profile.

4. The reclosable bag of claim 1 wherein said asymmetric arrowhead male profile has a first barb and a second barb, said first barb having an acute edge and said second barb having a rounded edge, said second barb being oriented toward said mouth of said reclosable bag.

5. The reclosable bag of claim 1 wherein said asymmetric arrowhead male profile is an integral part of said first wall and is coextruded therewith, and said female profile is an integral part of said second wall and is coextruded therewith.

6. The reclosable bag of claim 1 wherein said asymmetric arrowhead male profile is extruded and bonded to said first wall, and said female profile is extruded and bonded to said second wall.

7. The reclosable bag of claim 1 wherein said first stabilizer wedge of said male profile and said first stabilizer wedge of said female profile are inner stabilizer wedges with respect to said mouth, and make an angle with respect to one other when said bag is being opened from the outside, said angle controlling the force required to open said bag from the outside.

8. The reclosable bag of claim 1 wherein said second stabilizer wedge of said male profile and said second stabilizer wedge of said female profile are outer stabilizer wedges with respect to said mouth, and make an angle with respect to one other when said bag is being opened from the inside, said angle controlling the force required to open said bag from the inside.

* * * * *